US007515115B2

(12) United States Patent
Leisten et al.

(10) Patent No.: US 7,515,115 B2
(45) **Date of Patent: *Apr. 7, 2009**

(54) ANTENNA MANUFACTURE INCLUDING INDUCTANCE INCREASING REMOVAL OF CONDUCTIVE MATERIAL

(75) Inventors: Oliver Paul Leisten, Kingsthorpe (GB); Peter Wileman, Nr. Leamington Spa (GB)

(73) Assignee: Sarantel Limited, Wellingborough (GB)

( * ) Notice: Subject to any disclaimer, the term of this patent is extended or adjusted under 35 U.S.C. 154(b) by 335 days.

This patent is subject to a terminal disclaimer.

(21) Appl. No.: 11/005,743

(22) Filed: Dec. 7, 2004

(65) Prior Publication Data

US 2005/0115056 A1 Jun. 2, 2005

Related U.S. Application Data

(63) Continuation of application No. 09/517,782, filed on Mar. 2, 2000, now Pat. No. 6,886,237.

(30) Foreign Application Priority Data

Nov. 5, 1999 (GB) ..... 9926328.7

(51) Int. Cl.
*H01Q 1/36* (2006.01)
*H01P 11/00* (2006.01)

(52) U.S. Cl. ..... 343/895; 29/600; 29/852

(58) Field of Classification Search ..... 343/850, 343/895, 702, 796, 853; 29/600, 593, 847, 29/852

See application file for complete search history.

(56) References Cited

U.S. PATENT DOCUMENTS

| | | | | |
|---|---|---|---|---|
| 3,629,937 | A | 12/1971 | Fredriksson | 29/593 |
| 4,769,883 | A | 9/1988 | Nathanson | 29/867 |
| 4,771,291 | A | 9/1988 | Lo et al. | 29/895 |
| 5,191,352 | A | 3/1993 | Branson | 29/867 |
| 5,255,005 | A | 10/1993 | Terret | 29/852 |
| 5,349,365 | A | 9/1994 | Ow | 343/895 |
| 5,406,693 | A | 4/1995 | Egashira | 29/593 |
| 5,604,972 | A | 2/1997 | McCarrick | 29/842 |

(Continued)

FOREIGN PATENT DOCUMENTS

| | | |
|---|---|---|
| EP | 0 537 548 | 4/1993 |

(Continued)

OTHER PUBLICATIONS

Kennedy, G. and Davis, B., "Electronic Communication Systems," Fourth Edition; MacMillan/McGraw-Hill; Lake Forest, Illinois, pp. 188 and 200-201.

*Primary Examiner*—Douglas W Owens
*Assistant Examiner*—Jimmy T Vu
(74) *Attorney, Agent, or Firm*—John Bruckner PC

(57) ABSTRACT

In a method of producing a quadrifilar antenna for circularly polarised radiation at frequencies above 200 MHz, the antenna is tuned by coupling it to a test source, measuring the relative phases and amplitudes of currents at predetermined positions in the individual elements of the antenna by means of probes capacitively coupled to the elements, and laser etching apertures in the elements to increase their inductance, the sizes of the apertures being computed according to the deviation of the measured relative phases from predetermined values.

23 Claims, 4 Drawing Sheets

U.S. PATENT DOCUMENTS

| | | | | | |
|---|---|---|---|---|---|
| 5,635,945 | A | | 6/1997 | McConnell | 29/852 |
| 5,859,621 | A | * | 1/1999 | Leisten | 343/895 |
| 5,909,196 | A | | 6/1999 | O'Neill | 29/593 |
| 5,926,139 | A | | 7/1999 | Korisch | 29/602.1 |
| 5,963,180 | A | * | 10/1999 | Leisten | 343/895 |
| 5,977,932 | A | | 11/1999 | Robinson | 29/852 |
| 5,990,847 | A | * | 11/1999 | Filipovic et al. | 343/895 |
| 6,043,781 | A | | 3/2000 | Toh | 29/602.1 |
| 6,072,441 | A | | 6/2000 | Tanabe | 29/600 |
| 6,088,000 | A | | 7/2000 | Ho | 29/600 |
| 6,133,891 | A | | 10/2000 | Josypenko | 343/895 |
| 6,181,286 | B1 | | 1/2001 | Roscoe | 343/895 |
| 6,181,297 | B1 | | 1/2001 | Leisten | 29/852 |
| 6,184,845 | B1 | | 2/2001 | Leisten | 29/847 |
| 6,189,201 | B1 | | 2/2001 | Trzaskowskji | 29/602.1 |
| 6,204,827 | B1 | | 3/2001 | Endo | 29/602.1 |
| 6,369,776 | B1 | * | 4/2002 | Leisten et al. | 343/895 |
| 6,886,237 | B2 | * | 5/2005 | Leisten et al. | 29/600 |
| 7,439,934 | B2 | * | 10/2008 | Leisten et al. | 343/895 |

FOREIGN PATENT DOCUMENTS

| | | | |
|---|---|---|---|
| GB | 1 568 436 | | 5/1980 |
| GB | 2292638 | A | 2/1996 |
| GB | 2310543 | A | 8/1997 |
| GB | 2 321 785 | | 8/1998 |
| WO | WO98/24144 | | 6/1998 |
| WO | WO99/17398 | | 4/1999 |

* cited by examiner

ANTENNA MANUFACTURE INCLUDING INDUCTANCE INCREASING REMOVAL OF CONDUCTIVE MATERIAL

CROSS-REFERENCE TO RELATED APPLICATION

This application is a continuation of, and claims a benefit of priority under 35 U.S.C. 120 from utility patent application U.S. Ser. No. 09/517,782, filed Mar. 2, 2000, now U.S. Pat. No. 6,886,237 which in-turn claims a benefit of priority under one or more of 35 U.S.C. 119(a)-119(d) from United Kingdom patent application 9926328.7, filed Nov. 5, 1999, the entire contents of both of which are hereby expressly incorporated herein by reference for all purposes.

FIELD OF THE INVENTION

This invention relates to a method of producing an antenna, and primarily to a method of tuning a quadrifilar antenna for circularly polarised radiation at frequencies above 200 MHz. The invention also includes an antenna produced according to the method.

BACKGROUND OF THE INVENTION

The backfire quadrifilar antenna is well-known and has particular application in the transmission and reception of circularly polarised signals to or from orbiting satellites. British Patent Application No. 2292638A discloses a miniature quadrifilar antenna having four half-wavelength helical antenna elements in the form of narrow conductive strips plated on the surface of a cylindrical ceramic core. Connecting radial elements on a distal end face of the core connect the helical elements to a coaxial feeder passing axially through the core in a narrow passage. The helical elements are arranged in pairs, the elements of one pair having a greater electrical length than those of the other pair by virtue of their following a meandering course, all four elements being connected to the rim of a conductive balun sleeve which rim describes a circle lying in a plane perpendicular to the antenna axis. British Patent Application No. 2310543A discloses an alternative antenna in which the balun sleeve has a non-planar rim, the helical elements being simple helices which terminate in peaks and troughs respectively of the rim in order to yield elements of the required different lengths.

The fact that the pairs of elements have different electrical lengths results in a phase difference between the currents in the respective pairs at the operating frequency of the antenna, and it is this phase difference which makes the antenna sensitive to circularly polarised radiation with a cardioid radiation pattern such that the antenna is suited to receiving circularly polarised signals from sources which are directly above the antenna, i.e. on the antenna axis, or at locations a few degrees above a plane perpendicular to the axis and passing through the antenna, or from sources located anywhere in the solid angle between these extremes. The radiation pattern is also characterised by an axial null in the direction opposite to the direction of maximum gain.

The bandwidth of the above described quadrifilar resonance is relatively narrow and, particularly in the case of miniature quadrifilar antennas having a core of a high dielectric constant, presents a manufacturing difficulty in achieving sufficiently close dimensional tolerances to be able repeatedly to produce antennas having the required cardioid response and resonant frequency.

SUMMARY OF THE INVENTION

According to a first aspect of this invention, there is provided a method of producing a quadrifilar antenna for circularly polarised radiation at frequencies above 200 MHz, the antenna comprising a plurality of substantially helical conductive radiating tracks located on an electrically insulative substrate, wherein the method comprises monitoring at least one electric parameter of the antenna and removing conductive material from at least one of the tracks to bring the monitored parameter nearer to a predetermined value, thereby increase the inductance of the track and to improve the circularly polarised radiation pattern of the antenna. In this way, it is possible to trim antennas in large scale production without resort to individual testing in, for instance, an electromagnetically anechoic chamber and without excessive manual intervention.

The preferred method involves removing the conductive material from the tracks by laser etching an aperture in one or more of the tracks, leaving the opposing edges of the affected tracks intact on either side of each aperture. The method is particularly applicable to an antenna in which the substrate is a substantially cylindrical body of ceramic material having a relative dielectric constant greater than 10, the tracks including portions on a cylindrical surface of the substrate and, in addition, on a flat end surface of the substrate substantially perpendicular to the cylinder axis. In this case, the conductive material is removed from track portions located on the flat end surface which, in the preferred antenna, is close to the feed point for the antenna elements and is a location of a voltage minimum at the quadrifilar resonance. In alternative embodiments, the aperture or apertures may be cut in positions of other voltage minima, for example, where the helical elements join a common linking conductor such as a balun sleeve encircling the core.

The monitoring step typically comprising coupling the antenna to a radio frequency source which is arranged to sweep a band of frequencies containing the operating frequency, and monitoring the relative phases and amplitudes of signals picked up by probes brought into juxtaposition with the tracks at predetermined locations such as the end portions of the tracks remote from the feed point. Preferably, the probes are capacitively coupled to the respective tracks to avoid the need for individual ground connections to the antenna.

The apertures formed in the tracks are preferably rectangular, each having a predetermined width transverse to the direction of the track, the width being computed automatically in response to the result of the monitoring step. This is a non-linear adjustment process, in that the inductance of the track added by the aperture is non-linearly related to the aperture area, and specifically to the width of the rectangular aperture. Computation of the aperture size is performed so as to bring the phase difference of the currents and/or voltages in the tracks of respective track pairs nearer to 90° and to adjust the frequency at which this orthorgonality occurs so as to be nearer the intended operating frequency.

The invention also includes, according to a second aspect, a quadrifilar antenna for circularly polarised radiation at frequencies above 200 MHz, comprising a plurality of substantially helical conductive tracks located on an electrically insulative substrate, wherein at least one of the tracks has a cut-out of predetermined size for increasing the inductance of the track. The preferred antenna has a substrate comprising an antenna core formed of a solid dielectric material, the tracks being arranged to as to define an interior volume the major part of which is occupied by the solid material of the core, wherein the substrate has curved outer surface portions and flat surface portions supporting the conductive tracks, and with each cut-out being formed where the respective track lies over the one of the flat surface portions.

The invention will be described below by way of example with reference to the drawings.

DETAILED DESCRIPTION OF THE PREFERRED EMBODIMENT

Figure 1:
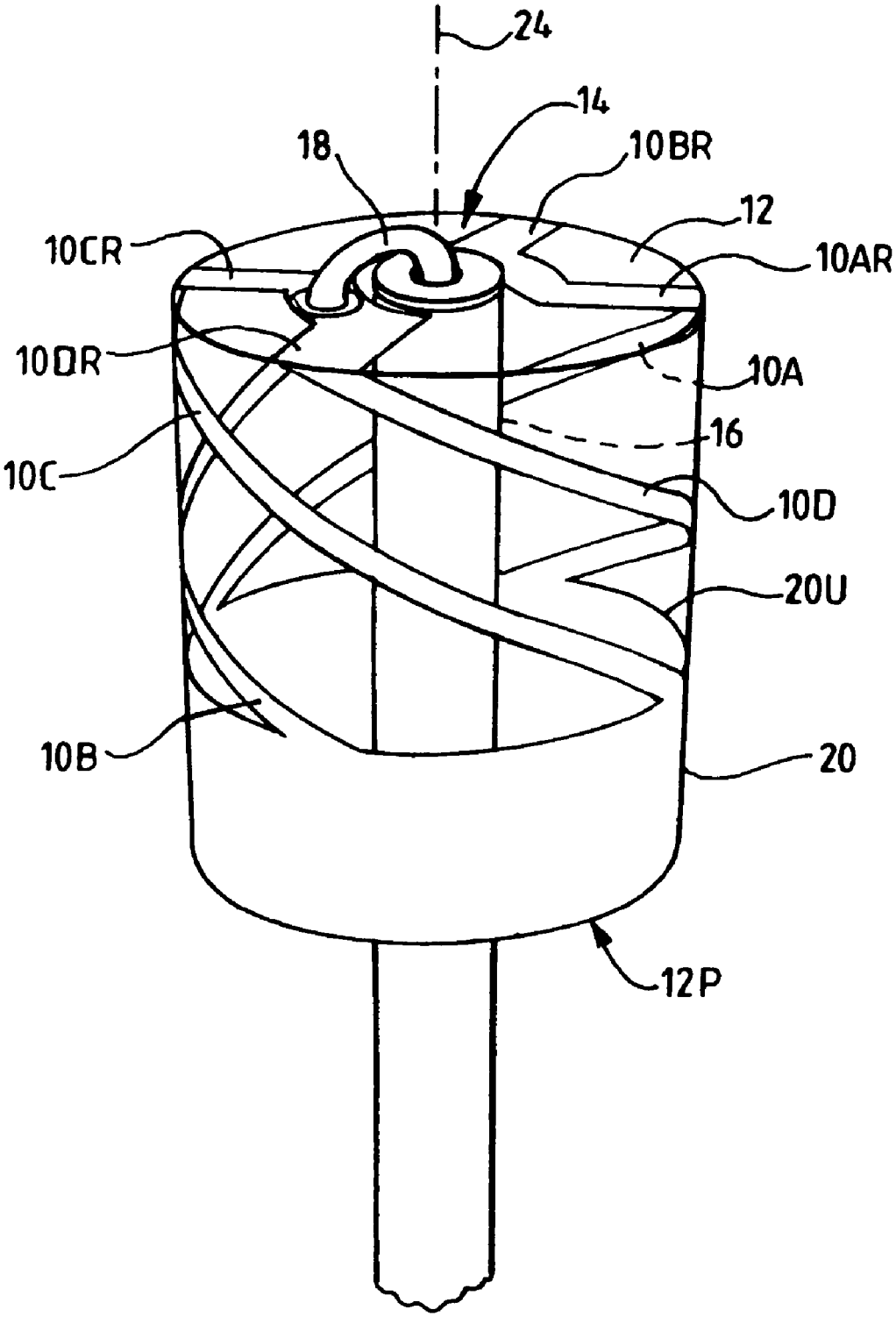
FIG. 1 is a see-through perspective view of a dielectrically-loaded quadrifilar antenna.

The quadrifilar antenna described below is similar to that described in the above-mentioned British Patent Application No. GB2310543A, the disclosure of which is incorporated in this specification by reference. The disclosure of the above-mentioned related Application No. GB2292638A is also incorporated in this specification by reference.

Referring to FIG. 1, 2A, 2B and 3, an antenna to which the present invention is applicable has an antenna element structure with four longitudinally extending antenna elements 10A, 10B, 10C, and 10D formed as narrow metallic conductor track portions on the cylindrical outer surface of a ceramic core 12. The core has an axial passage 14 housing a coaxial feeder with an outer screen 16 and an inner conductor 18. The inner conductor 18 and the screen 16 form a feeder structure for connecting a feed line to the antenna elements 10A-10D. The antenna element structure also includes corresponding radial antenna elements 10AR, 10BR, 10CR, 10DR formed as metallic track portions on a distal end face of the core 12, connecting ends of the respective longitudinally extending elements 10A-10D to the feeder structure. The other ends of the antenna elements 10A-10D are connected to a common virtual ground conductor 20 in the form of a plated sleeve surrounding a proximal end portion of the core 12. This sleeve 20 is in turn connected to the screen 16 of the feeder structure 14 by plating on the proximal end face 12P of the core 12.

The four longitudinally extending elements 10A-10D are of different lengths, two of the elements 10B, 10D being longer than the other two 10A, 10C by virtue of extending nearer the proximal end of the core 12. The elements of each pair 10A, 10C; 10B, 10D are diametrically opposite each other on opposite sides of the core axis.

In order to maintain approximately uniform radiation resistance for the helical elements 10A-10D, each element follows a simple helical path. The upper linking edge 20U of the sleeve 20 is of varying height (i.e. varying distance from the proximal end face 12P) to provide points of connection for the long and short elements respectively. Thus, in this embodiment, the linking edge 20U follows a shallow zig-zag path around the core 12, having two peaks and two troughs where it meets the short elements 10A, 10C and long elements 10B, 10D respectively, the amplitude of the zig-zag being shown in FIG. 3 as a.

Each pair of helical and corresponding connecting radial element portions (for example 10A, 10AR) constitutes a conductor having a predetermined electrical length. Each of the element pairs 10A, 10AR; 10C, 10CR having the shorter length produces a shorter transmission approximately 135° at the operating wavelength than each of the element pairs 10B, 10BR; 10D, 10DR. The average transmission delay being 180°, equivalent to an electrical length of $\lambda/2$ at the operating wavelength. The differing lengths produce the required phase shift conditions for a quadrifilar helix antenna for circularly polarised signals specified in Kilgus, "Resonant Quadrifilar Helix Design", The Microwave Journal, December 1970, pages 49-54. Two of the element pairs 10C, 10CR; 10D, 10DR (i.e. one long element pair and one short element pair) are connected at the inner ends of the radial elements 10CR, 10DR to the inner conductor 18 of the feeder structure at the distal end of the core 12, while the radial elements of the other two element pairs 10A, 10AR; 10B, 10BR are connected to the feeder screen formed by outer screen 16. At the distal end of the feeder structure, the signals present on the inner conductor 18 and the feeder screen 16 are approximately balanced so that the antenna elements are connected to an approximately balanced source or load, as will be explained below. It will be appreciated that, in the general case, the tracks formed by the track portions 10A-10D and 10AR-10DR may have an average electrical length of $n\lambda/2$ where n is an integer and each may execute n/2 turns about the antenna axis 24.

With the left handed sense of the helical paths of the longitudinally extending elements 10A-10D, the antenna has its highest gain for right hand circularly polarised signals.

If the antenna is to be used instead for left hand circularly polarised signals, the direction of the helices is reversed and the pattern of connection of the radial elements is rotated through about 90°. In the case of an antenna suitable for receiving both left hand and right hand circularly polarised signals, the longitudinally extending elements can be arranged to follow paths which are generally parallel to the axis.

The conductive sleeve 20 covers a proximal portion of the antenna core 12, thereby surrounding the feeder structure 16, 18, with the material of the core 12 filling the whole of the space between the sleeve 20 and the metallic lining 16 of the axial passage 14. The sleeve 20 forms a cylinder connected to the lining 16 by the plating of the proximal end face 12P of the core 12. The combination of the sleeve 20 and plating 22 forms a balun so that signals in the transmission line formed by the feeder structure 16, 18 are converted between an unbalanced state at the proximal end of the antenna and an approximately balanced state at an axial position generally at the same distance from the proximal end as the upper linking edge 20U of the sleeve 20. To achieve this effect, the average sleeve length is such that, in the presence of an underlying core material of relatively high relative dielectric constant, the balun has an average electrical length in the region of $\lambda/4$ at the operating frequency of the antenna. Since the core material of the antenna has a foreshortening effect, and the annular space surrounding the inner conductor 18 is filled with an insulating dielectric material having a relatively small dielectric constant, the feeder structure distally of the sleeve 20 has a short electrical length. Consequently, signals at the distal end of the feeder structure 16, 18 are at least approximately balanced.

The trap formed by the sleeve 20 provides an annular path along the linking edge 20U for currents between the elements 10A-10D, effectively forming two loops of different electrical lengths, the first with short elements 10A, 10C and the second with the long elements 10B, 10D. At quadrifilar resonance current maxima and voltage minima exist at the ends of the elements 10A-10D and in the linking edge 20U. The edge 20U is effectively isolated from the ground connector at its proximal edge due to the approximate quarter wavelength trap produced by the sleeve 20.

The antenna has a main quadrifilar resonant frequency for circularly polarised radiation in the region of 1575 MHz, the resonant frequency being determined by the effective electrical lengths of the antenna elements and, to a lesser degree, by their width. The lengths of the elements, for a given frequency of resonance, are also dependent on the relative dielectric constant of the core material, the dimensions of the antenna being substantially reduced with respect to an air-cored similarly constructed antenna.

The preferred material for the core 12 is zirconium-titanate-based material. This material has a relative dielectric constant in excess of 35 and is noted also for its dimensional and electrical stability with varying temperature. Dielectric loss is negligible. The core may be produced by extrusion or pressing.

The antenna elements 10A-10D, 10AR-10DR are metallic conductor tracks bonded to the outer cylindrical and end surfaces of the core 12, each track being of a width at least four times its thickness over its operative length. The tracks may be formed by initially plating the surfaces of the core 12 with a metallic layer and then selectively etching away the layer to expose the core according to a pattern applied in a photographic layer similar to that used for etching printed circuit boards. In all cases, the formation of the tracks as an integral layer on the outside of a dimensionally stable core leads to an antenna having dimensionally stable antenna elements. The circumferential spacing between the helical track portions is greater than (preferably more than twice) their width.

Figure 2A:
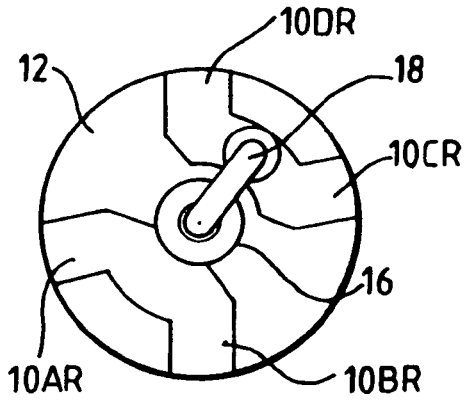
FIGS. 2A and 2B are top plan views of the antenna of FIG. 1 before and after adjustment in accordance with the invention.
Figure 2B:
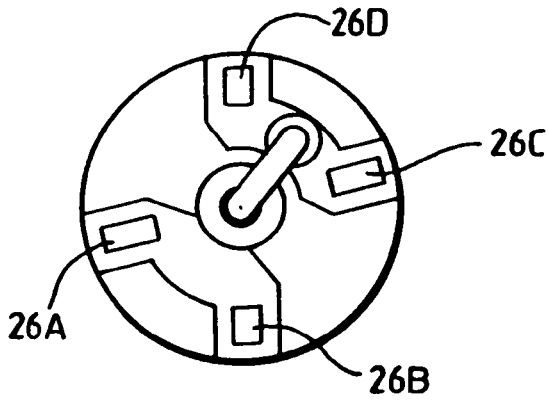
Figure 3:
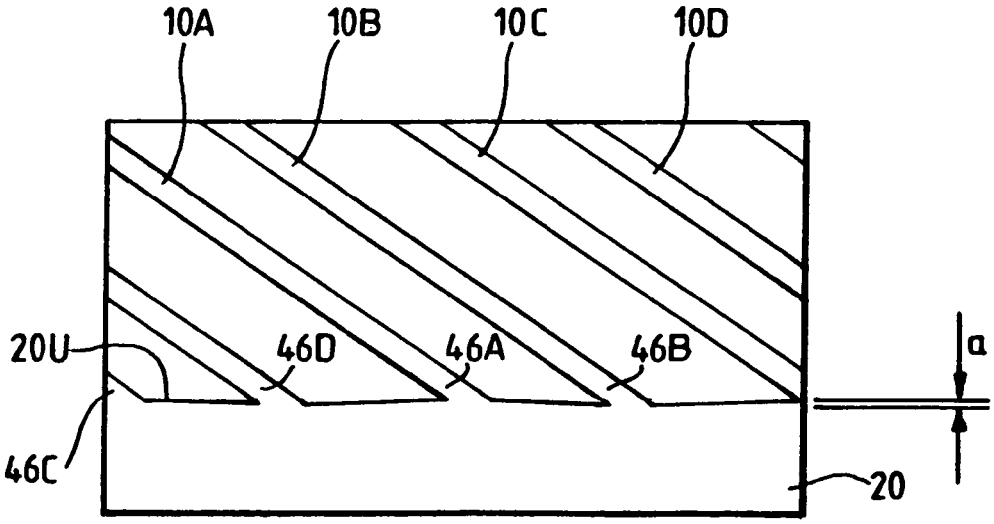
FIG. 3 is a diagram illustrating the conductor pattern on the cylindrical surface of the antenna of FIG. 1.

To achieve a radiation pattern having, a good front-to-back ratio together with acceptable gain and to achieve this radiation pattern at the required operating frequency, the antenna as described above and shown in FIG. 1 is subjected to a trimming process in which conductive material is removed from the conductive tracks to form apertures, as shown in FIG. 2B. The apertures 26A, 26B, 26C, and 26D are formed in the connecting track portions 10AR, 10BR, 10CR, and 10DR respectively where, at the operating frequency, voltage minima exist. Since these track portions lie in a plane, it is comparatively straightforward to focus a laser-beam on the tracks in the required position on order to etch the conductive material of the tracks using a YAG laser. Each aperture increases the inherent inductance of its respective track 10A, 10AR, etc. to a degree dependent on the area of the aperture. The applicants have found that the added inductance increases non-linearly at an increasing rate as the width of the aperture is increased (i.e. the width of the aperture across the track). The variation of the added inductance with the length of the aperture (i.e. longitudinally of the track) is an approximately linear relationship. These relationships allow both coarse and fine adjustments of the inductance to be made, if necessary.

Figure 4:
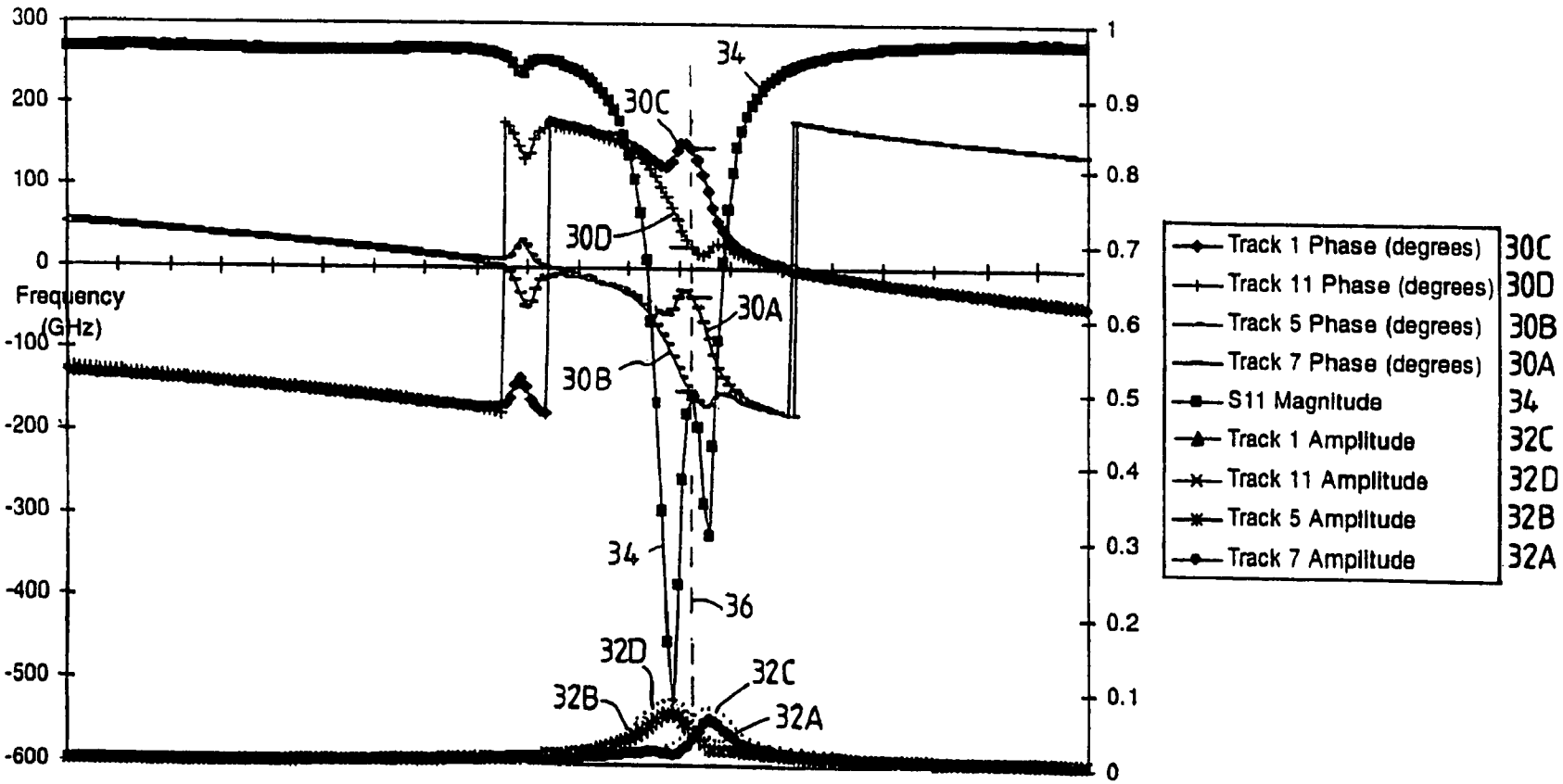
FIG. 4 is a graph showing the variation of phase and amplitude with frequency of signals measured at different points on the antenna.

A better understanding of the way in which the antenna operates and the affect of the apertures will be obtained by referring to the graph of FIG. 4. FIG. 4 was obtained by monitoring the radio frequency currents in the helical track portions 10A, 10B, 10C, and 10D adjacent the rim 20U of the sleeve 20 (i.e. the currents in the proximal end portions of the helical track position 10A-10D) whilst the antenna was fed through its feeder structure 16, 18 with a swept frequency signal over a band encompassing the required operating frequency. There are four traces representing current phase and four representing current amplitude, each phase and amplitude trace being associated with one of the track portions 10A-10D. The phase traces are indicated by the reference numerals 30A, 30B, 30C, and 30D and the amplitude traces are indicated by the reference numerals 32A, 32B, 32C, and 32D. For completeness, a ninth trace 34 indicates the insertion loss looking into the feeder structure at the source end.

The diagram of FIG. 4 shows a main resonance having two coupled peaks. It will be seen that the amplitude traces 32A, 32C, which correspond to the shorter tracks 10A, 10C, have peaks on the high frequency side of the central resonant frequency, whilst the amplitude traces 32B, 32D have peaks on the low frequency side. It will be understood that the intersections of these four amplitude traces can be used to define a centre frequency, which is indicated in FIG. 4 by the dotted line 36. Now referring to the four current phase traces 30A-30D it will be seen that those corresponding to the tracks connected to the feeder outer screen, 30A, 30B, diverge in the region of the resonance. Similarly, there is a divergence between the traces 30C, 30D corresponding to the current phases in the tracks connected to the inner conductor 18 of the feeder. The main condition for obtaining a good front-to-back ratio in the radiation pattern for circular polarisation is that the phase difference between the respective signals in the long and short tracks should be 90° or an odd integer multiple of 90° ($\lambda/4$). Therefore, referring to FIG. 4, at the centre frequency indicated by dotted line 36, the phase values indicated by phase traces 30A, 30B should differ by as nearly as possible 90° and, similarly, the phase values indicated by traces 30C and 30D should also differ by 90°.

Naturally, the centre frequency indicated by dotted line 36 should correspond to the required operating frequency of the antenna as well.

It is possible by adjusting the inductance of one or more of the tracks 10A, 10AR, etc. to align or trim the antenna to achieve the phase orthogonality and centre frequency referred to above. For instance, the divergence of the phases at the centre frequency can be reduced by increasing the inductance of the shorter tracks 10A, 10AR and 10C, 10CR. The centre frequency can be reduced by increasing the inductance of all four tracks. It follows that to make full use of the adjustment facility provided by cutting apertures, the antenna should, initially, be manufactured so as to have tracks which are electrically shorter than the optimum lengths at the required operating frequency.

These concepts may be used, in accordance with the invention, as the basis for an automated antenna trimming process to reduce or eliminate the deviation in the antenna electrical parameters (such as signal phase and amplitude in the radiating element) from the required optimum values. In this way, it is possible to manufacture antennas relatively cheaply using an initial low tolerance manufacturing process without resort to expensive and labour-intensive manufacturing and trimming methods.

A test arrangement for performing the phase and amplitude measurements will now be described with reference to FIGS. 5 and 6. To monitor phase and amplitude in the region of the required operating frequency, the antenna 40 is moved into a testing location at the centre of a star-configuration probe array formed by probes 42A, 42B, 42C, and 42D slidably mounted on radial tracks 44A, 44B, 44C, and 44D. In the test location, the antenna 40 is situated at a required height and rotational orientation (made possible by a notch (not shown) cut in one of the edges of the antenna end faces), so that the probes 42A to 42D are in registry with the proximal end portions 46A, 46B, 46C, 44D, of the tracks 10A, 10AR, to 10D, 10DR, i.e. adjacent the rim 20U of the balun sleeve 20 (see FIG. 1). The feed structure of the antenna 40 is proximally connected to the output 48 of a swept frequency r.f. source in a test unit.

Figure 6:
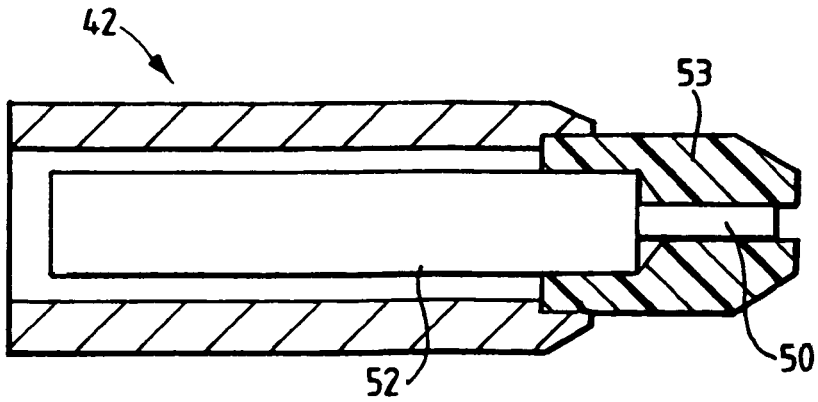
FIG. 6 is a cross-section through one of the probes visible in FIG. 5.

Referring to FIG. 6, each probe 42 is a capacitive probe having a centre conductor 50 coupled to the inner conductor of a coaxial cable 52, the screen of which is grounded to the test assembly. The centre conductor 50 projects from the cable 52 but is surrounded by a plastics dielectric tip 53 which extends by a predetermined distance (typically less than 0.5 mms) beyond the end of the centre conductor so that each probe 42A to 42D may be brought into contact with the outer surface of the antenna 40 with the tip of the centre conductor 50 spaced at a predetermined spacing from the respective helical track portion 10A to 10D. Each centre conductor 50 is, therefore, capacitively coupled to the associated track, and transmits signals representative of the current in the track to its associated cable 52 and thence to a respective measuring input 54A, 54B, 54C, and 54D of a test unit (see FIG. 5).

Figure 5:
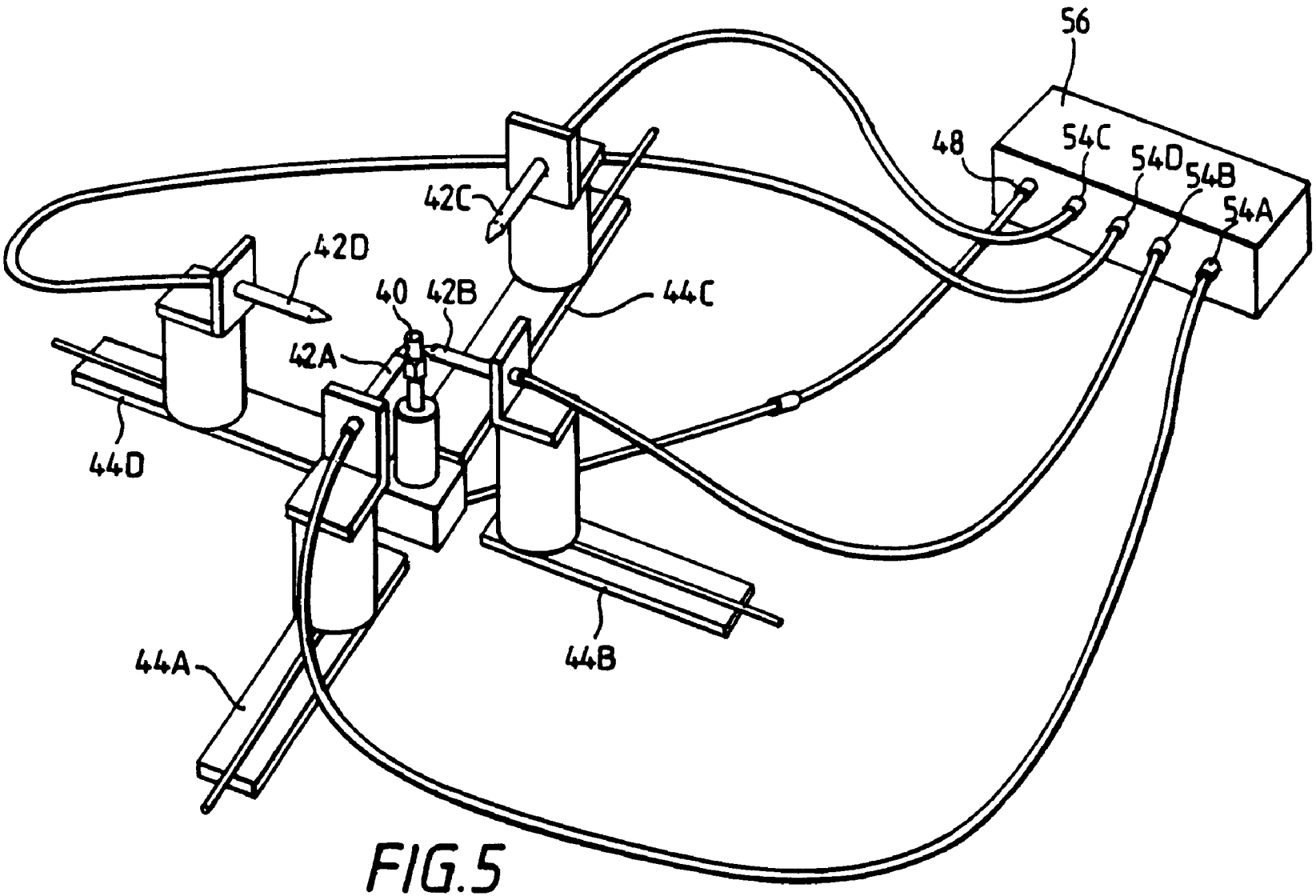
FIG. 5 is a diagram showing a test arrangement for use in a production method in accordance with the invention.

It will be noted that in FIG. 5 two of the probes 42A, 42B are shown in their operative positions in contact with the antenna 40, while the other two probes 42C, 42D are shown withdrawn in the positions they adopt when one antenna is exchanged for another. Each probes 42A to 42D is piston-mounted for automated travelling between the retracted and operative positions.

During the test process, all four probes 42A-42D are brought into contact with the antenna 40, a swept radio frequency signal is applied to the antenna from output 48 of the test unit 56, and the probe signals received at inputs 54A to 54D are monitored. A centre frequency is computed by detecting the intersections of the amplitude characteristics (as described above with reference to FIG. 4) and then the phase values of the individual signals at that frequency are read to determine their deviation from orthogonality, and a data set is generated from the readings, from which data set the required aperture sizes can be computed. A laser (not shown) then etches the apertures in the exposed distal end face of the antenna as described above, whereupon another dataset can be produced to check that the phase orthogonality and centre frequency fall within specified limits.

In effect, the test unit computes a crossover frequency representing the closest convergence of the four amplitude traces, marks the corresponding frequency, reads the four phase values at that frequency to compute the phase differences, and then computes the required added conductance for each track in order to shift the crossover frequency to the required frequency (in this case the GPS frequency of 1575.5 MHz) with the correct phase orthogonality. This is performed by calculating an LC (inductance×capacitance) product for each track.

The required aperture size is then computed and the laser is controlled to etch the aperture or apertures.

The antenna may then be automatically removed from the test location shown in FIG. 5 to be fed to a finishing process.

In instances of the antenna being small compared to the probes, it is preferred that the relative dielectric constant of the antenna core is at least 10, and is preferably 35 or higher, in order that the probes do not materially affect the antenna characteristics during the above-described test.

The capacitive probes pick up signals representative of the very near field and are, therefore, able to provide signals corresponding to the currents in the individual tracks.

This allows deduction of the far field pattern, in accordance with the phase relationships described above.

The removal of material is preferably performed by a pulsed YAG laser which allows metal ablation substantially without melting so as to provide precise dimensional control.

It is possible to form the apertures in the tracks at alternative positions, such as in the proximal end portions of the track portions 10A to 10D, providing alternative probe locations are chosen.

It will be understood that while this invention has been described by reference to a method of producing a quadrifilar antenna, the method may also be applied to other wire antennas (i.e. antennas having conductors which are narrow compared to the spacing between them).

What is claimed is:

1. A method of producing a quadrifilar antenna for circularly polarised radiation at frequencies above 200 MHz, the antenna comprising a plurality of substantially helical conductive radiating tracks located on an electrically insulative substrate, wherein the method comprises monitoring at least one electrical parameter of the antenna and removing conductive material from at least one of the tracks in such a way as to increase the inductance of the track and thereby to bring the monitored parameter closer to a predetermined value, wherein the conductive material is removed from the track by laser etching an aperture in the track, leaving the edges of the track intact on either side of the aperture.

2. A method of producing a quadrifilar antenna for circularly polarised radiation at frequencies above 200 MHz, the antenna comprising a plurality of substantially helical conductive radiating tracks located on an electrically insulative substrate, wherein the method comprises monitoring at least one electrical parameter of the antenna and removing conductive material from at least one of the tracks in such a way as to increase the inductance of the track and thereby to bring the monitored parameter closer to a predetermined value in which the substrate is substantially cylindrical and the tracks include portions on a cylindrical surface of the substrate and a flat surface of the substrate, wherein the conductive material is removed from a track portion or portions located on the flat surface.

3. A method according to claim 2, wherein the flat surface is an end surface of the cylindrical substrate, which surface is substantially perpendicular to a cylinder axis, and wherein the conductive material is removed from at least one a track portion located on the end surface.

4. A method of producing a quadrifilar antenna for circularly polarised radiation at frequencies above 200 MHz, the antenna comprising a plurality of substantially helical conductive radiating tracks located on an electrically insulative substrate, wherein the method comprises monitoring at least one electrical parameter of the antenna and removing conductive material from at least one of the tracks in such a way as to increase the inductance of the track and thereby to bring the monitored parameter closer to a predetermined value having a plurality of helical track portions located in a substantially cylindrical substrate surface, and a plurality of respective connecting track portions located on a substantially flat end surface of the substrate to connect the helical track portions to an axial feeder, wherein the material removal step comprises forming a cut-out in at least one of the connecting track portions.

5. A method of producing a quadrifilar antenna for circularly polarised radiation at frequencies above 200 MHz, the antenna comprising a plurality of substantially helical conductive radiating tracks located on an electrically insulative substrate, wherein the method comprises monitoring at least one electrical parameter of the antenna and removing conductive material from at least one of the tracks to bring the monitored parameter closer to a predetermined value, thereby to increase the inductance of the track, wherein the monitoring step comprises coupling the antenna to a radio frequency source, bringing probes into juxtaposition with the tracks at predetermined locations, and measuring at least the relative phases of signals picked up by the probes associated with different respective tracks when the radio frequency is operated.

6. A method according to claim 5, wherein the probes are capacitively coupled to the respective tracks.

7. A method according to claim 5, wherein the probes are located in registry with track portions corresponding to the positions of voltage minima when the radio frequency source is tuned to the intended operating frequency of the antenna.

8. A method according to claim 5, wherein the probes are located in registry with end portions of the helical tracks.

9. A method according to claim 5 for producing an antenna in which each track has a first end portion adjacent a feed location and a second, opposite end portion spaced from the said feed location, wherein the material removal step comprises forming cut-outs in the first end portions and the monitoring step includes positioning the probes in juxtaposition with the second end portions.

10. A method according to claim 5, including monitoring relative phases of signals in the radiating tracks to bring the difference between the monitored phases at a central resonance frequency closer to 90°.

11. A method of producing a quadrifilar antenna for circularly polarised radiation at frequencies above 200 MHz, the antenna comprising a plurality of substantially helical conductive radiating tracks located on an electrically insulative substrate, wherein the method comprises monitoring at least one electrical Parameter of the antenna and removing conductive material from at least one of the tracks in such a way as to increase the inductance of the track and thereby to bring the monitored parameter closer to a predetermined value, wherein material is removed from the tracks by forming a rectangular aperture in each affected track, the aperture having a predetermined width transverse to the direction of the track which is computed automatically in response to the result of the monitoring step.

12. A method according to claim 11, wherein with the width and length of the aperture are variable in response to the said monitoring result.

13. A method of producing a quadrifilar antenna for circularly polarised radiation at frequencies above 200 MHz, the antenna comprising a plurality of substantially helical conductive radiating tracks located on an electrically insulative substrate, wherein the method comprises monitoring at least one electrical parameter of the antenna and removing conductive material from at least one of the tracks in such a way as to increase the inductance of the track and thereby to bring the monitored parameter closer to a predetermined value, wherein the monitoring step includes feeding the antenna with a swept frequency signal over a frequency range including the intended operating frequency of the antenna, monitoring the relative phases and amplitudes of signals in the radiating tracks, and removing conductive material from at least two of the tracks to bring the frequency at which substantial phase orthogonality occurs closer to the intended operating frequency.

14. A method of producing a quadrifilar antenna for circularly polarised radiation at frequencies above 200 MHz, the antenna comprising a plurality of substantially helical conductive radiating tracks located on an electrically insulative substrate, wherein the method comprises monitoring at least one electrical Parameter of the antenna and removing conductive material from at least one of the tracks in such a way as to increase the inductance of the track and thereby to bring the monitored parameter closer to a predetermined value, wherein the monitoring step includes feeding the antenna with a swept frequency signal over a frequency range including the intended operating frequency of the antenna, monitoring the relative phases and amplitudes of signals in the radiating tracks to bring the difference between the monitored phases at a central resonant frequency closer to 90°.

15. A method of producing a quadrifilar antenna for circularly polarised radiation at frequencies above 200 MHz, the antenna comprising a plurality of helical conductive radiating tracks located on an electrically insulative substrate, wherein the method comprises monitoring at least one electrical parameter of the antenna and removing conductive material from at least one of the tracks to bring the monitored parameter closer to a predetermined value, thereby to increase the inductance of the track, and wherein the monitoring step comprises coupling the antenna to a radio frequency source, bringing probes into juxtaposition with the tracks at predetermined locations, and measuring at least the relative amplitudes of radio frequency signals picked up by the probes associated with different respective tracks when the radio frequency source is operated.

16. A method according to claim 15, wherein the probes are capacitively coupled to the respective tracks.

17. A method according to claim 15, wherein the probes are located in registry with track portions corresponding to the positions of voltage minima when the radio frequency source is tuned to the intended operating frequency of the antenna.

18. A method according to claim 15, wherein the probes are located in registry with end portions of the helical tracks.

19. A method according to claim 15, wherein the material removal step comprises forming cut-outs in the first end portions and the monitoring step includes positioning the probes in juxtaposition with the second end portions.

20. A method of producing a quadrifilar antenna for circularly polarised radiation at frequencies above 200 MHz, the antenna comprising a plurality of helical conductive radiating tracks located on an electrically insulative substrate, wherein the method comprises monitoring at least one electrical parameter of the antenna and removing conductive material from at least one of the tracks to form an aperture in each affected track to increase the inductance of the track and thereby to bring the monitored parameter closer to a predetermined value, wherein the aperture is rectangular.

21. A method of producing a quadrifilar antenna for circularly polarised radiation at frequencies above 200 MHz, the antenna comprising a plurality of helical conductive radiating tracks located on an electrically insulative substrate, wherein the method comprises monitoring at least one electrical parameter of the antenna and removing conductive material from at least one of the tracks to bring the monitored parameter closer to a predetermined value, thereby to increase the inductance of the track, and wherein the monitoring step includes feeding the antenna with a swept frequency signal over a frequency range including the intended operating frequency of the antenna, and monitoring the relative amplitudes of signals in the radiating tracks.

22. A method of producing a quadrifilar antenna for circularly polarised radiation at frequencies above 200 MHz, the antenna comprising a plurality of substantially helical conductive radiating tracks located on an electrically insulative substrate, wherein the method comprises monitoring at least one electrical parameter of the antenna and removing conductive material from at least one of the tracks in such a way as to increase the inductance of the track and thereby to bring the monitored parameter closer to a predetermined value and monitoring relative phases of signals in the radiating tracks to bring the difference between the monitored phases at a central resonant frequency closer to 90°.

23. A method of producing a quadrifilar antenna for circularly polarised radiation at frequencies above 200 MHz, the antenna comprising a plurality of substantially helical conductive radiating tracks located on an electrically insulative substrate, wherein the method comprises monitoring at least one electrical parameter of the antenna and removing conductive material from at least one of the tracks in such a way as to increase the inductance of the track and thereby to bring the monitored parameter closer to a predetermined value, wherein the monitoring step includes monitoring radio frequency signals in different ones of said tracks and measuring associated relative values of said parameter.

* * * * *